US010856627B2

(12) United States Patent
Ying

(10) Patent No.: US 10,856,627 B2
(45) Date of Patent: Dec. 8, 2020

(54) LABOR-SAVING CONNECTION STRUCTURE AND LUGGAGE BINDING STRAP WITH THE SAME

(71) Applicant: Shanghai Well-Signed International Trade Co., Ltd., Shanghai (CN)

(72) Inventor: Chen Ying, Shanghai (CN)

(73) Assignee: Shanghai Well-Signed International Trade Co., Ltd., Shanghai (CN)

( * ) Notice: Subject to any disclaimer, the term of this patent is extended or adjusted under 35 U.S.C. 154(b) by 0 days.

(21) Appl. No.: 16/349,910

(22) PCT Filed: May 26, 2017

(86) PCT No.: PCT/CN2017/086093
§ 371 (c)(1),
(2) Date: May 14, 2019

(87) PCT Pub. No.: WO2018/196082
PCT Pub. Date: Nov. 1, 2018

(65) Prior Publication Data

US 2019/0335860 A1 Nov. 7, 2019

(30) Foreign Application Priority Data

Apr. 28, 2017 (CN) ..... 2017 1 0291187

(51) Int. Cl.
*A44B 11/14* (2006.01)
*A45C 13/10* (2006.01)
*A45C 13/30* (2006.01)

(52) U.S. Cl.
CPC ..... *A44B 11/14* (2013.01); *A45C 13/1092* (2013.01); *A45C 13/30* (2013.01); *Y10T 24/2192* (2015.01)

(58) Field of Classification Search
CPC ... A44B 11/14; A44B 11/2526; Y10T 24/262; Y10T 24/404; Y10T 24/4072; Y10T 24/2192; Y10T 24/2175; E05C 19/14
(Continued)

(56) References Cited

U.S. PATENT DOCUMENTS 3,252,188 A * 5/1966 Davis ..... B65D 63/16 24/68 E
3,584,912 A * 6/1971 Leger ..... B60J 7/1851 296/117

(Continued)

FOREIGN PATENT DOCUMENTS

CN 2803073 Y 8/2006
CN 202283986 U 6/2012

(Continued)

*Primary Examiner* — Robert Sandy
*Assistant Examiner* — Michael S Lee
(74) *Attorney, Agent, or Firm* — Muncy, Geissler, Olds & Lowe, P.C.

(57) ABSTRACT

The invention discloses a labor-saving connection structure and a luggage binding strap with the same. The labor-saving connection structure comprises a first connection portion and a second connection portion, and the first connection portion is capable of coupled with the second connection portion. An auxiliary closing mechanism is further arranged on the first connection portion to snap in the second connection portion during coupling connection between the first connection portion and the second connection portion, and drive the first connection portion and the second connection portion to move towards each other to realize the coupling connection therebetween. The labor-saving connection structure is simple in structure, and the first connection portion and the second connection portion are capable of being easily coupled through the auxiliary closing mechanism.

10 Claims, 7 Drawing Sheets

(58) Field of Classification Search
USPC ..... 63/1.18, 3.1
See application file for complete search history.

(56) References Cited

U.S. PATENT DOCUMENTS 4,127,305 A * 11/1978 Nielsen ..... B60B 11/02
292/113
2016/0174665 A1 6/2016 Kung

FOREIGN PATENT DOCUMENTS

CN 104720250 A 6/2015
JP H10-225318 A 8/1998

* cited by examiner

LABOR-SAVING CONNECTION STRUCTURE AND LUGGAGE BINDING STRAP WITH THE SAME

FIELD OF THE INVENTION

The invention relates to a binding strap for luggage, in particular to a labor-saving connection structure for auxiliary connection and a luggage binding strap with the same.

DESCRIPTION OF THE RELATED ART

Luggage is necessary for packing clothes, valuables and certificates when people go for a trip, especially when they go abroad. In addition to a plurality of compartments sealed with zippers for holding luggage, a binding strap is normally provided to bind the luggage to prevent the contents from falling off, being damaged or being lost due to loose or damaged zippers when the luggage is transported.

FIG. 1 discloses a luggage A of the prior art and a binding strap B for binding the same. The binding strap B comprises a strap body B1, a socket B2 and a plug B3 arranged at both ends of the strap body, respectively, and a ladder-shaped adjusting ring B4 arranged on the strap body B1 for adjusting length of the strap body.

However, there are some problems in use of the binding strap. The binding strap is normally used following two processes: first, adjusting the length of the binding strap before inserting the plug into the socket. The length of the binding strap is adjusted according to the size of the luggage body. After adjustment, the forced insertion of the plug into the socket requires high strength, which is inconvenient for users with a little strength or arm weakness. The second process is inserting the plug into the socket before adjusting the length of the binding strap. As the binding strap is already bound on the luggage body, the length needs to be gradually adjusted with abundant time and labor, and the binding strap may not be adjusted to the tightest status due to the complex binding.

In order to solve the problem of the inconvenient use of the binding strap, other binding straps gradually occurred in the market. For example, Chinese Patent No. CN02140931 discloses a luggage binding strap with a ratchet mechanism and a lock, wherein the ratchet mechanism is arranged to the end of the binding strap to assist in drawing and contracting the binding strap. For another example, Chinese patent application No. CN200420058439 discloses a binding strap for luggage, wherein a more complex rack and a slide fastener are arranged on both ends of the binding strap, so that the binding strap is slidably embedded in the slide fastener through ratchets arranged on the inner side of the rack, and tightened to the selected position through the abutting part in the slide fastener. The contents disclosed in these two patents contain great changes to the binding strap of the prior art, which are involved in relatively complicated structure and high cost.

SUMMARY OF THE INVENTION

With regard to the shortcomings above in the prior art, the invention discloses a luggage binding strap, with a purpose of easily inserting a plug into a socket by using an auxiliary closing structure after adjusting the length of the binding strap.

The invention solves these shortcomings through the following technical solutions:

A labor-saving connection structure, comprising a first connection portion and a second connection portion, the first connection portion being coupled with the second connection portion, wherein an auxiliary closing mechanism is further arranged on the first connection portion to snap in the second connection portion during coupling connection between the first connection portion and the second connection portion, and drive the first connection portion and the second connection portion to move towards each other to realize coupling connection therebetween.

Preferably, the auxiliary closing mechanism comprises a grip and a lever force applying plate; an end of the grip is pivotably connected with the lever force applying plate on both sides, and an end of the lever force applying plate is pivotably connected with an end of the first connection portion; the grip is connected with the second connection portion during the coupling connection between the first connection portion and the second connection portion, and the lever force applying plate pushes the first connection portion so that the first connection portion and the second connection portion move towards each other to realize the coupling connection therebetween.

Preferably, the grip is connected with an upper surface of the second connection portion.

Preferably, the grip comprises a downwards protruded insertion strip arranged at the top end and two fixed edges extending backwards from both sides of the insertion strip; the insertion strip is snapped in the upper surface of the second connection portion; and both sides of the lever force applying plate are arranged between the two fixed edges through bolts, pins or buckles.

Preferably, a plurality of convex-concave points or concave-convex strips are arranged on the contacting part between the insertion strip and the upper surface of the second connection portion.

Preferably, the distance from the insertion strip to the contacting part between the lever force applying plate and the fixed edges is not less than the distance from the end of the lever force applying plate to the contacting part between the lever force applying plate and the fixed edges.

Preferably, a slot or a convex strip matched with the insertion strip is arranged on the upper surface of the second connection portion.

Preferably, the first connection portion and the second connection portion are intercoupled in a socket joint mode.

Preferably, the first connection portion and the second connection portion are intercoupled plug and socket, respectively.

Preferably, the auxiliary closing mechanism is fixedly connected with the first connection portion through bolts, pins or buckles.

A luggage binding strap, comprising the labor-saving connection structure and a strap body, wherein both ends of the strap body are connected with the first connection portion and the second connection portion of the labor-saving connection structure, respectively.

Preferably, an adjusting mechanism is arranged on the strap body to adjust length of the strap body.

Preferably, a marking line is set on the strap body to indicate the length of the strap body.

Preferably, distance of every interval indicated on the marking line located near both ends of the first connection portion and the second connection portion is twice that of the interval indicated on the marking line located near the adjusting mechanism.

With the technical means above, the luggage binding strap of the present application can be used to easily insert the plug into the socket through the auxiliary closing structure after the length of the strap body is adjusted. The invention is low in cost, simple in structure and convenient in manufacturing, has no significant change to the plug and socket structures of the prior art, and can be achieved through simple screw combination.

DESCRIPTION OF THE PREFERRED EMBODIMENTS

The present invention will be described in detail below in combination with specific embodiments.

Figure 1:
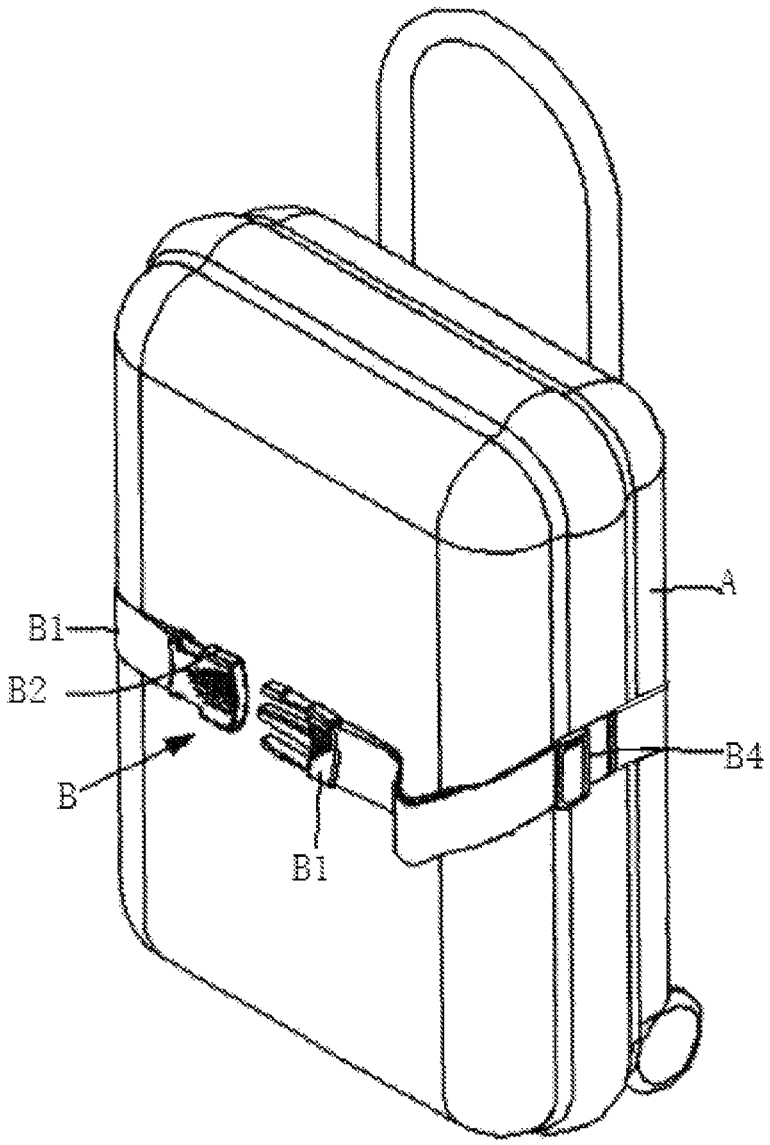
FIG. 1 is a structural diagram showing the binding strap of prior art binding a luggage.
Figure 2:
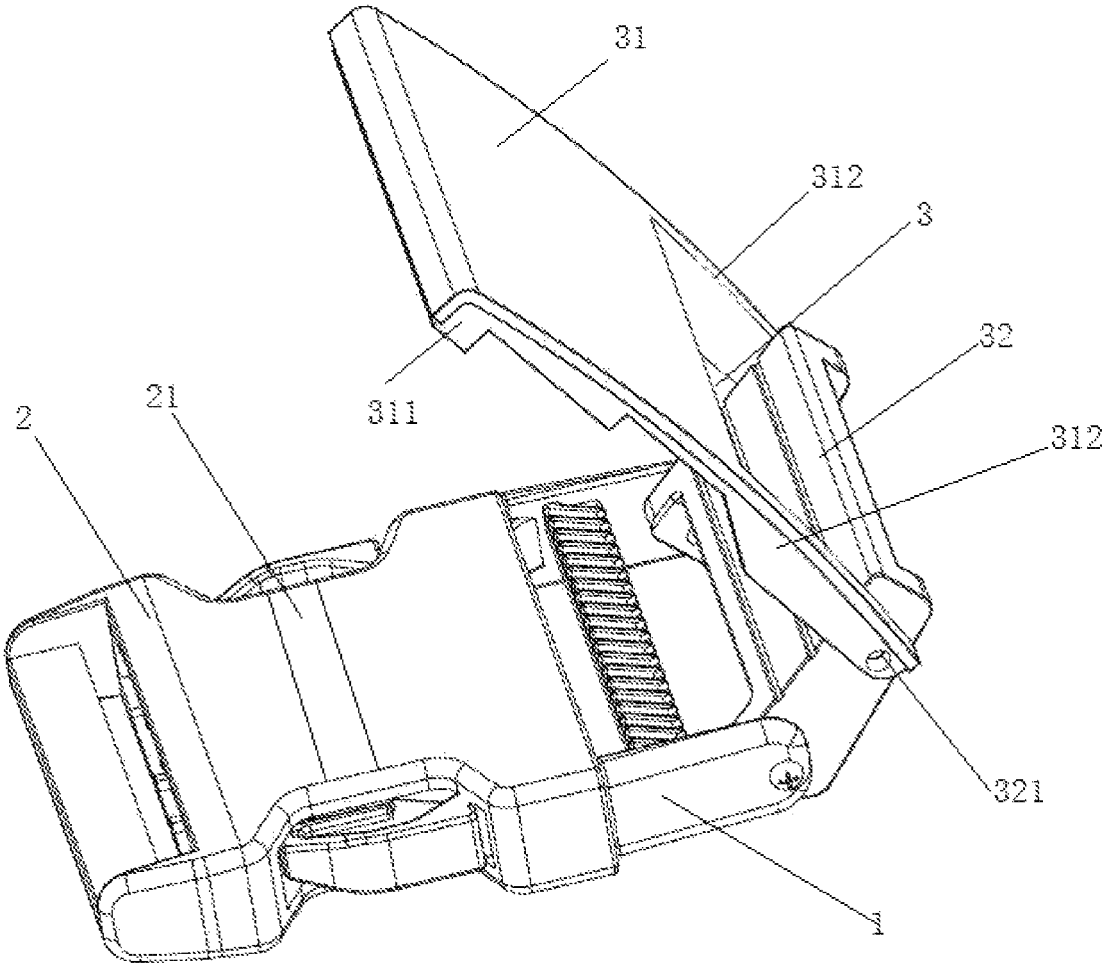
FIG. 2 is a structural diagram I for an embodiment of the labor-saving connection structure of the present application.

FIG. 2 is a structural diagram for an embodiment of the present application.

The labor-saving connection structure of the embodiment comprises a first connection portion 1 and a second connection portion 2. The first connection portion 1 and the second connection portion 2 are intercoupled, and an auxiliary closing mechanism 3 is further arranged on the first connection portion 1. When the first connection portion 1 is coupled with the second connection portion 2, the auxiliary closing mechanism 3 is snapped in the second connection portion 3, and drives the first connection portion 1 and the second connection portion 3 to move toward each other to realize coupling connection.

Figure 3:
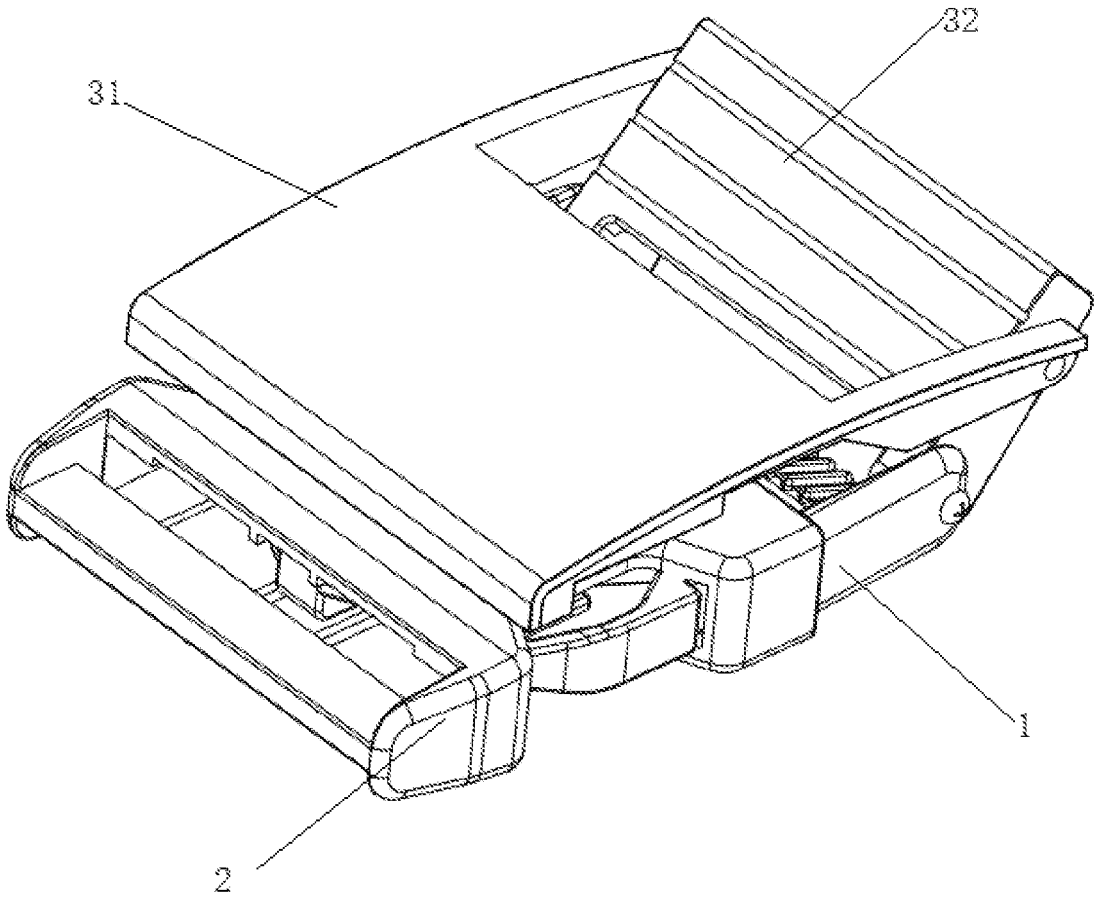
FIG. 3 is a schematic diagram II for the embodiment of FIG. 2.

Refer to FIG. 2, the auxiliary closing mechanism 3 comprises a grip 31 and a lever force applying plate 32. Both sides of the lever force applying plate 32 are pivotably connected with the end of the grip 31. The end of the lever force applying plate 32 is pivotably connected with the end of the first connection portion 1 by bolts (or pins or buckles). The grip 31 is connected with an upper surface of the second connection portion 2 during the coupling connection between the first connection portion 1 and the second connection portion 2, as shown in FIG. 3. The lever force applying plate 32 pushes the first connection portion 1, and the first connection portion 1 and the second connection portion 2 move toward each other to realize the coupling connection therebetween, which is convenient and labor-saving.

The detailed structure of the auxiliary closing mechanism 3 is shown in FIG. 2 and FIG. 3. The grip 31 comprises a downwards protruded insertion strip 311 arranged at the top end and two fixed edges 312 extending backwards from both sides of the insertion strip 311. The insertion strip 311 is snapped in the upper surface of the second connection portion 2, and both sides of the lever force applying plate 32 are arranged between the two fixed edges 312 through bolts (or pins or buckles). The specific shape of the pull grip 31 is not limited, and it is only required to ensure that the grip 31 is provided with the insertion strip and the structure (fixed edges 312) in contact with the lever force applying plate.

To further ensure that the auxiliary closing mechanism 3 is well connected on the upper surface of the second connection portion 2, a plurality of convex-concave points or concave-convex strips are arranged on the contacting part between the insertion strip 311 and the upper surface of the second connection portion 2. In addition, a slot 21 or a convex strip matched with the insertion strip is arranged on the upper surface of the second connection portion 2. Sufficient mating force is provided during the coupling of the first connection portion 1 and the second connection portion 2 by snap connection between the slot 21 or convex strip and the insertion strip 311.

In addition, to better utilize the lever force applying plate 32 and enable it to provide the maximum thrust pushing the first connection portion 1, the distance from insertion strip 311 to the contacting part between the lever force applying plate 32 and the fixed edges 312 is not be less than the distance from the contacting part between the lever force applying plate 32 and the fixed edge 312 to the end of the lever force applying plate 32.

In the first embodiment, the first connection portion 1 and the second connection portion 2 are intercoupled in a socket joint mode. The first connection portion 1 and the second connection portion 2 are intercoupled plug and socket, respectively, as shown in FIG. 2 and FIG. 3 of the embodiment.

As shown in FIG. 2, the plug (the first connection portion) and the socket (the second connection portion) insertion structure are common coupled structures. The socket is provided with a jack that has I-shaped cross-section. The plug is provided with an insertion tongue which is disconnected at the front end, and a concave slot is provided respectively at both sides of the insertion tongue. When the plug is inserted into the socket, the front end of the plug contracts inwards. After the tongue is inserted into the jack and passes through the middle portion of the jack, the tongue at both ends bounces outwards due to elastic force. The slot is in snap connection with the edge of the jack to prevent the tongue from falling out of the jack. The auxiliary closing mechanism 3 of the present application provides assistance when the tongue is inserted into the jack until elastic force recovers.

The advantages of the application are simple structure, minor change to production process, and cost saving. It is not required to significantly change the structure of the plug and socket or change the existing production line of the plug. It is only necessary to add a process step after the end of the existing plug production process, that is, connecting the auxiliary closing mechanism of the present application to end of the plug by screws, which has low manufacturing cost.

Of course, the first connection portion and the second connection portion of the present application are not limited to the structures of the plug and the socket and can be other connection structures.

Figure 4:
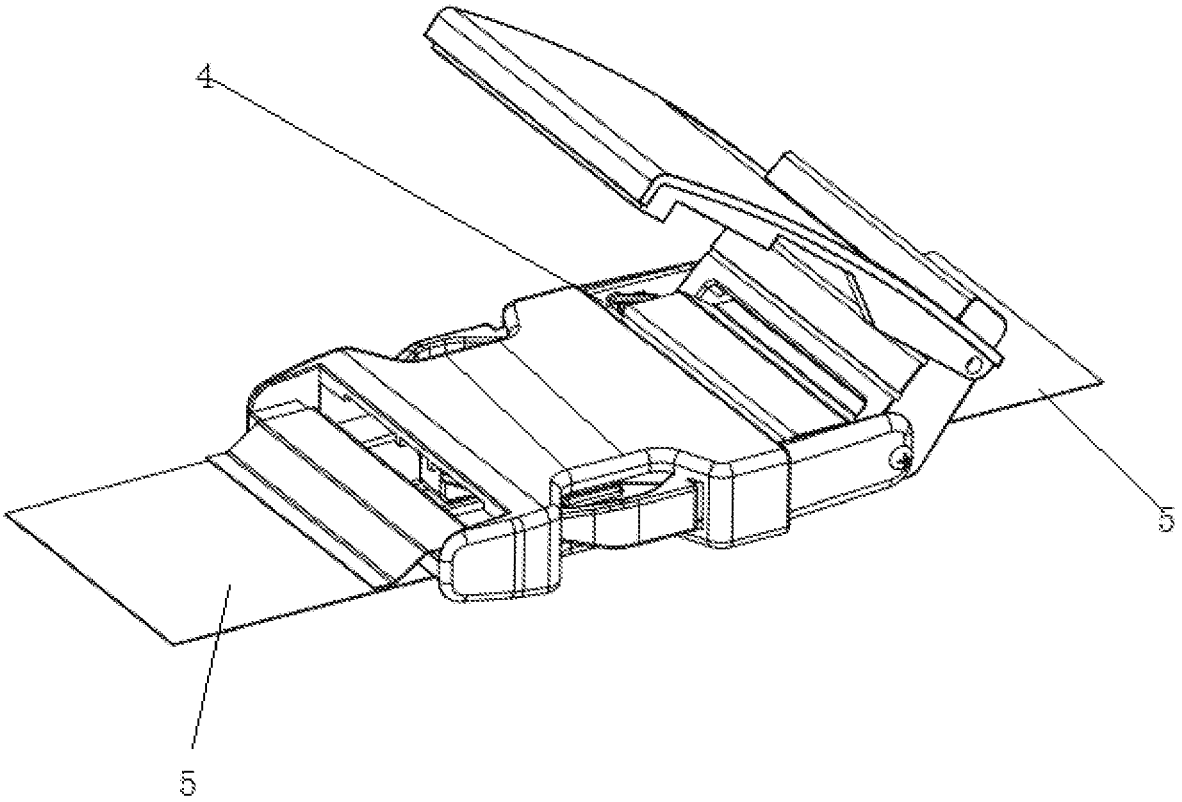
FIG. 4 is a local diagram I for an embodiment of the luggage binding strap.
Figure 5:
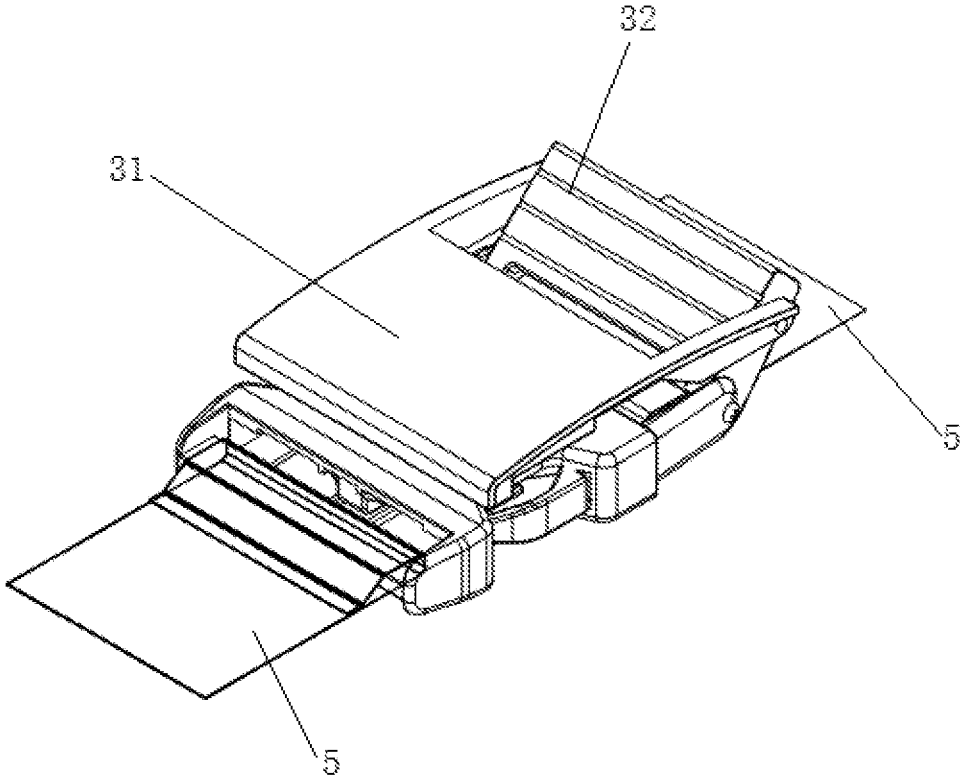
FIG. 5 is a schematic diagram II for the embodiment of FIG. 4.

Furthermore, as shown in FIGS. 4 and 5, the present application also discloses a luggage binding strap, wherein the luggage binding strap comprises the labor-saving connection structure 4 and a strap body 5, and both ends of the strap body 5 are connected with the first connection portion 1 and the second connection portion 2 of the labor-saving connection structure 4, respectively. An adjusting mechanism is arranged on the strap body 5 to adjust length of the strap body 6.

Figure 6:
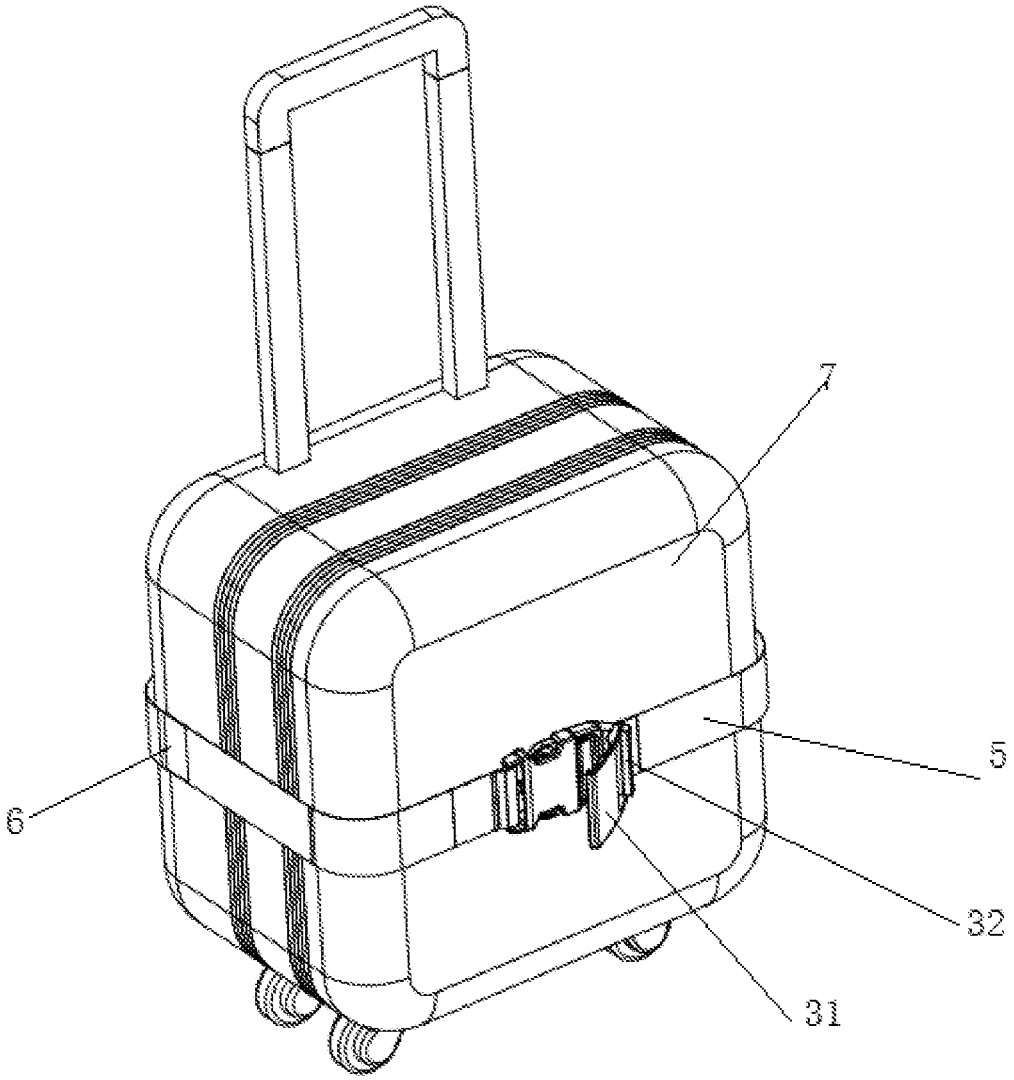
FIG. 6 is a schematic diagram for a usage state of the embodiment of the luggage binding strap shown in FIG. 4.
Figure 7:
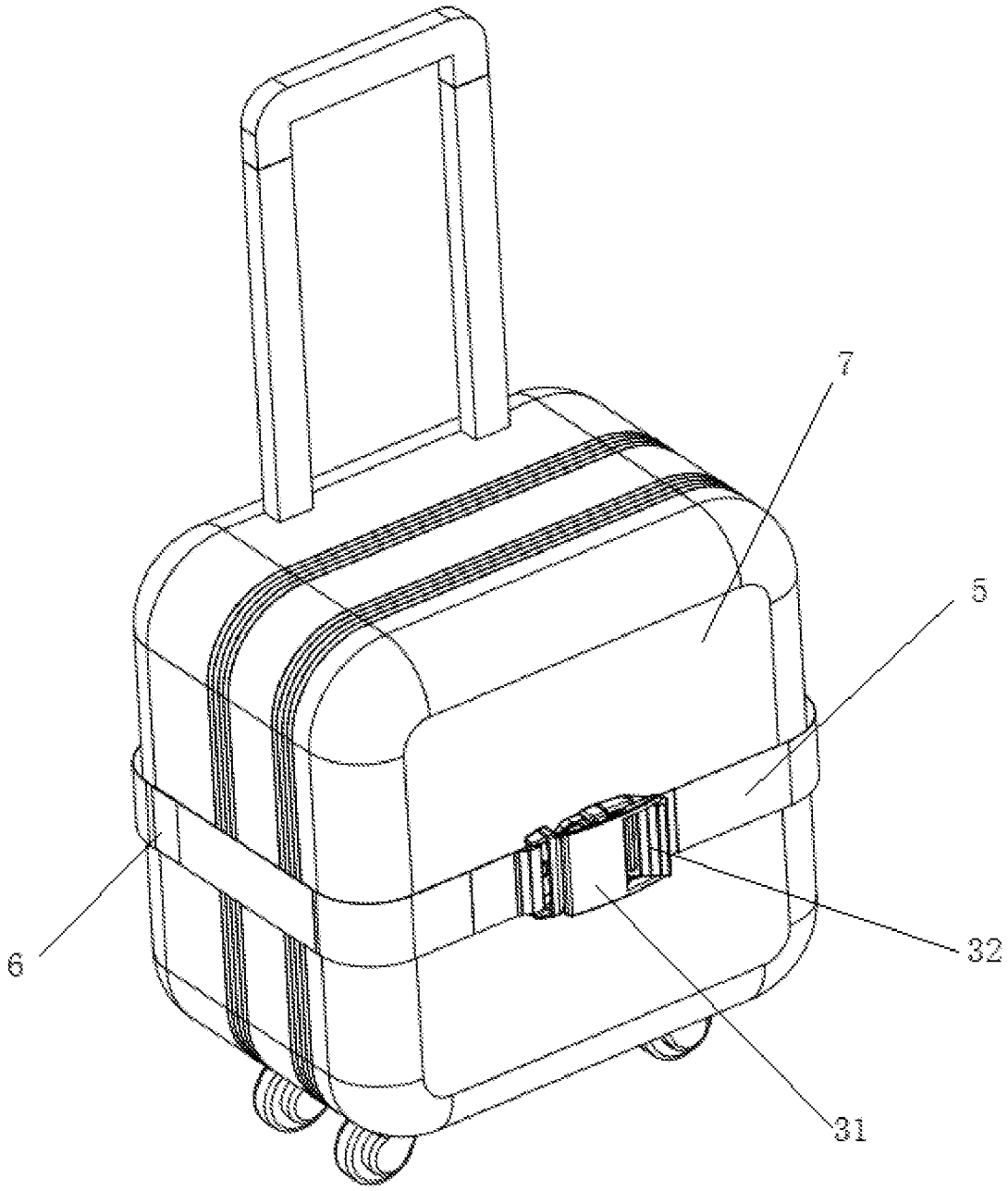
FIG. 7 is a schematic diagram of another state of FIG. 6.

Thanks to the labor-saving connection structure, when the luggage 7 is strapped by the binding strap, the length of the binding strap can be properly adjusted in advance, so that the length of the binding strap plus the first connection portion 1 and the second connection portion 2 matches the luggage body 7. As shown in FIG. 6, the first connection portion 1 is aligned with the second connection portion 2. Since the strap body 5 is fastened to the luggage body, when the first connection portion 1 and the second connection portion 2 are coupled, it is laborious to push the first connection portion 1 into the second connection portion 2. At this time, as shown in FIG. 7, through the labor-saving connection structure, the grip is fixed to the upper surface of the second connection portion, and then the lever force applying plate is pushed to easily couple the first connection portion 1 and the second connection portion 2.

Moreover, a transparent pocket for placing a nameplate can be arranged on the upper surface of the grip 31, so that the identity information of the luggage owner is displayed in the pocket after packing for identification.

In addition, to facilitate the user to adjust the strap body, a marking line is set on the strap body to indicate the length of the strap body. The adjusting mechanism is at the double overlap of the strap body, since distance of every interval indicated on the marking line located near both ends of the first connection portion and the second connection portion is deliberately set to be twice the distance of every interval indicated on the marking line located near the adjustment mechanism.

In summary, the labor-saving connection structure of the present application can easily complete the coupling action when the length of the strap body is properly adjusted, which is convenient and labor-saving.

It should be understood that these embodiments are for illustrative purposes only and are not intended to limit the scope of the invention. In addition, it should be understood that various changes and modifications can be made to the present invention by those skilled in the art after they read the present invention. These equivalent forms will also fall into the protection scope as defined by the appended claims of the present application.

The invention claimed is:

1. A luggage binding strap, wherein the luggage binding strap comprises a labor-saving connection structure and a strap body, wherein the labor-saving connection structure comprises a first connection portion and a second connection portion, the first connection portion being coupled with the second connection portion, wherein an auxiliary closing mechanism is further arranged on the first connection portion to snap in the second connection portion during coupling connection between the first connection portion and the second connection portion, and drive the first connection portion and the second connection portion to move towards each other to realize coupling connection therebetween, and both ends of the strap body are connected with the first connection portion and the second connection portion of the labor-saving connection structure, respectively.

2. The luggage binding strap according to claim 1, wherein an adjusting mechanism is arranged on the strap body to adjust length of the strap body.

3. The luggage binding strap according to claim 1, wherein the auxiliary closing mechanism comprises a grip and a lever force applying plate; an end of the grip is pivotably connected with the lever force applying plate on both sides, and an end of the lever force applying plate is pivotably connected with an end of the first connection portion; the grip is connected with the second connection portion during the coupling connection between the first connection portion and the second connection portion, and the lever force applying plate pushes the first connection portion so that the first connection portion and the second connection portion move towards each other to realize the coupling connection therebetween.

4. The luggage binding strap according to claim 3, wherein the grip is connected with an upper surface of the second connection portion.

5. The luggage binding strap according to claim 4, wherein a slot or a convex strip matched with the insertion strip is arranged on the upper surface of the second connection portion.

6. The luggage binding strap according to claim 3, wherein the grip comprises a downwards protruded insertion strip arranged at the top end and two fixed edges extending backwards from both sides of the insertion strip; the insertion strip is snapped in the upper surface of the second connection portion; and both sides of the lever force applying plate are arranged between the two fixed edges through bolts, pins or buckles.

7. The luggage binding strap according to claim 6, wherein the distance from the insertion strip to the contacting part between the lever force applying plate and the fixed edges is not less than the distance from the end of the lever force applying plate to the contacting part between the lever force applying plate and the fixed edges.

8. The luggage binding strap according to claim 1, wherein the first connection portion and the second connection portion are intercoupled in a socket joint mode.

9. The luggage binding strap according to claim 8, wherein the first connection portion and the second connection portion are intercoupled plug and socket, respectively.

10. The luggage binding strap according to claim 1, wherein the auxiliary closing mechanism is fixedly connected with the first connection portion through bolts, pins or buckles.

* * * * *